US005308072A

United States Patent [19]

Pettinelli et al.

[11] Patent Number: 5,308,072

[45] Date of Patent: May 3, 1994

[54] GOLF CLUB COUNTERWEIGHT APPARATUS

[76] Inventors: Anthony J. Pettinelli, 6377 Elmer Hill Rd.; Carl Heim, Jr., 7328 Coleman Mills Rd., both of Rome, N.Y. 13440

[21] Appl. No.: 44,763

[22] Filed: Apr. 12, 1993

[51] Int. Cl.[5] ..... A63B 69/36

[52] U.S. Cl. ..... 273/187.4; 273/194 R; 273/163 A

[58] Field of Search ..... 273/187.4, 193 R, 194 R, 273/194 B, 193 A, 188 R, 189 R, 186.1, 186.2, 187.2, 165, 162 R, 163 R, 163 A, 164.1, 81 D, 81 A, 77 R

[56] References Cited

U.S. PATENT DOCUMENTS

| | | | |
|---|---|---|---|
| 3,918,721 | 11/1975 | Trask | 273/194 R X |
| 3,951,416 | 4/1976 | Koch | 273/187.4 X |
| 4,491,323 | 1/1985 | Kozub | 273/81 D |
| 4,781,382 | 11/1988 | Hargraves | 273/187.4 X |
| 5,009,426 | 4/1991 | Cox | 273/194 R X |
| 5,125,657 | 6/1992 | Beil | 273/162 R X |
| 5,152,533 | 10/1992 | Radakovich | 273/194 R X |
| 5,167,415 | 12/1992 | Iandola | 273/193 R X |
| 5,203,568 | 4/1993 | Vasquez | 273/194 R X |

*Primary Examiner*—Vincent Millin
*Assistant Examiner*—Sebastiano Passaniti
*Attorney, Agent, or Firm*—Leon Gilden

[57] ABSTRACT

A golf club counterweight structure is arranged to include a golf club shank having a handle and a golf club head, with the head projecting at a second end from a club first end, with a support rod mounted to the handle at a free end of the handle extending in a spaced relationship relative to the handle, including a counterweight member joined to the handle at a junction oriented substantially aligned relative to the free end, with the counterweight positioned over the club second end for enhanced guidance and swing control for use of the club structure as a golf putter.

5 Claims, 4 Drawing Sheets

GOLF CLUB COUNTERWEIGHT APPARATUS

BACKGROUND OF THE INVENTION

1. Field of the Invention

The field of invention relates to golf club apparatus, and more particularly pertains to a new and improved golf club counterweight apparatus arranged for enhancing use of a golf club putter.

2. Description of the Prior Art

Putting in a golfing environment requires steady alignment of the putter structure relative to a target ball. Prior art patents are available for this purpose and indicated in U.S. Pat. Nos. 4,844,468; 4,872,684; 4,895,371; 4,898,387; and 4,962,932.

The instant invention attempts to overcome deficiencies of the prior art by providing for a counterweight structure projecting beyond the golf club handle and mounted to the handle providing for proper alignment and positioning of the hands relative to the handle and orientation of the golf club relative to an individual's body and in this respect, the present invention substantially fulfills this need.

SUMMARY OF THE INVENTION

In view of the foregoing disadvantages inherent in the known types of golf club apparatus now present in the prior art, the present invention provides a golf club counterweight apparatus wherein the same mounts a counterweight relative to a free end of a handle for proper orientation of the golfer's hands and body relative to the handle. As such, the general purpose of the present invention, which will be described subsequently in greater detail, is to provide a new and improved golf club counterweight apparatus which has all the advantages of the prior art golf club apparatus and none of the disadvantages.

To attain this, the present invention provides a golf club counterweight structure arranged to include a golf club shank having a handle and a golf club head, with the head projecting at a second end from a club first end, with a support rod mounted to the handle at a free end of the handle extending in a spaced relationship relative to the handle, including a counterweight member joined to the handle at a junction oriented substantially aligned relative to the free end, with the counterweight positioned over the club second end for enhanced guidance and swing control for use of the club structure as a golf putter.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf club counterweight apparatus which has all the advantages of the prior art golf club counterweight apparatus and none of the disadvantages.

It is another object of the present invention to provide a new and improved golf club counterweight apparatus which may be easily and efficiently manufactured and marketed.

It is a further object of the present invention to provide a new and improved golf club counterweight apparatus which is of a durable and reliable construction.

An even further object of the present invention is to provide a new and improved golf club counterweight apparatus which is susceptible of a low cost of manufacture with regard to both materials and labor, and which accordingly is then susceptible of low prices of sale to the consuming public, thereby making such golf club counterweight apparatus economically available to the buying public.

Still yet another object of the present invention is to provide a new and improved golf club counterweight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
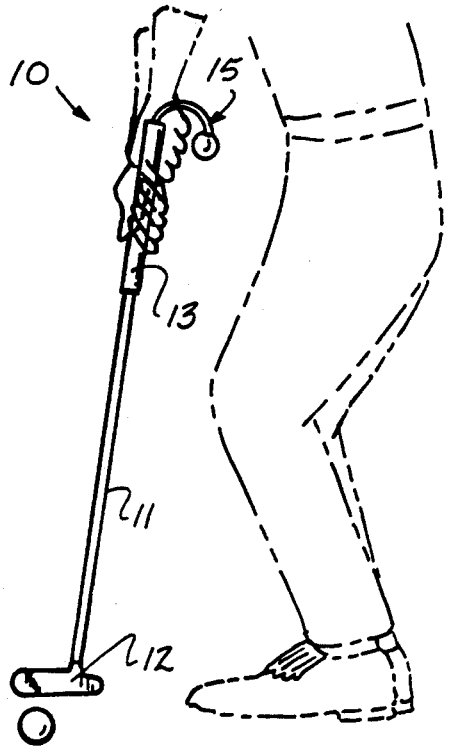
FIG. 1 is an orthographic view of the invention in use.
Figure 2:
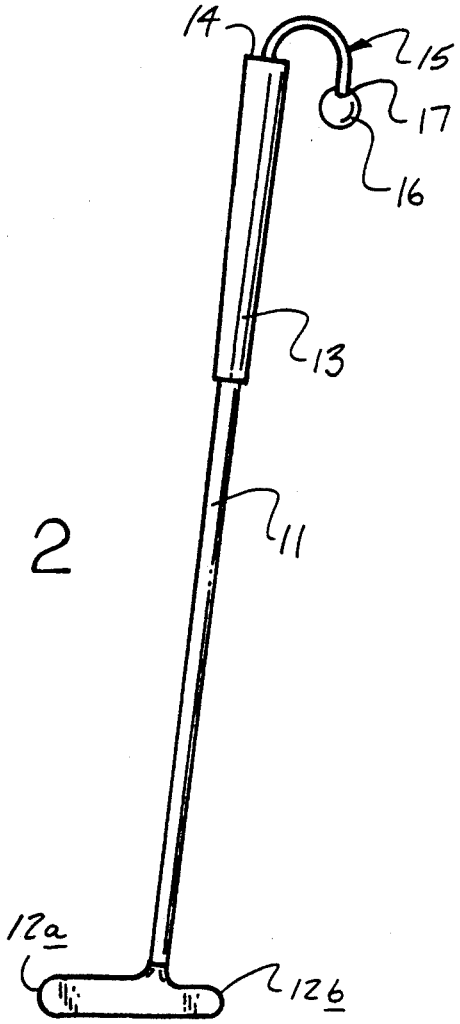
FIG. 2 is an enlarged orthographic view of the golf club of the invention.
Figure 3:
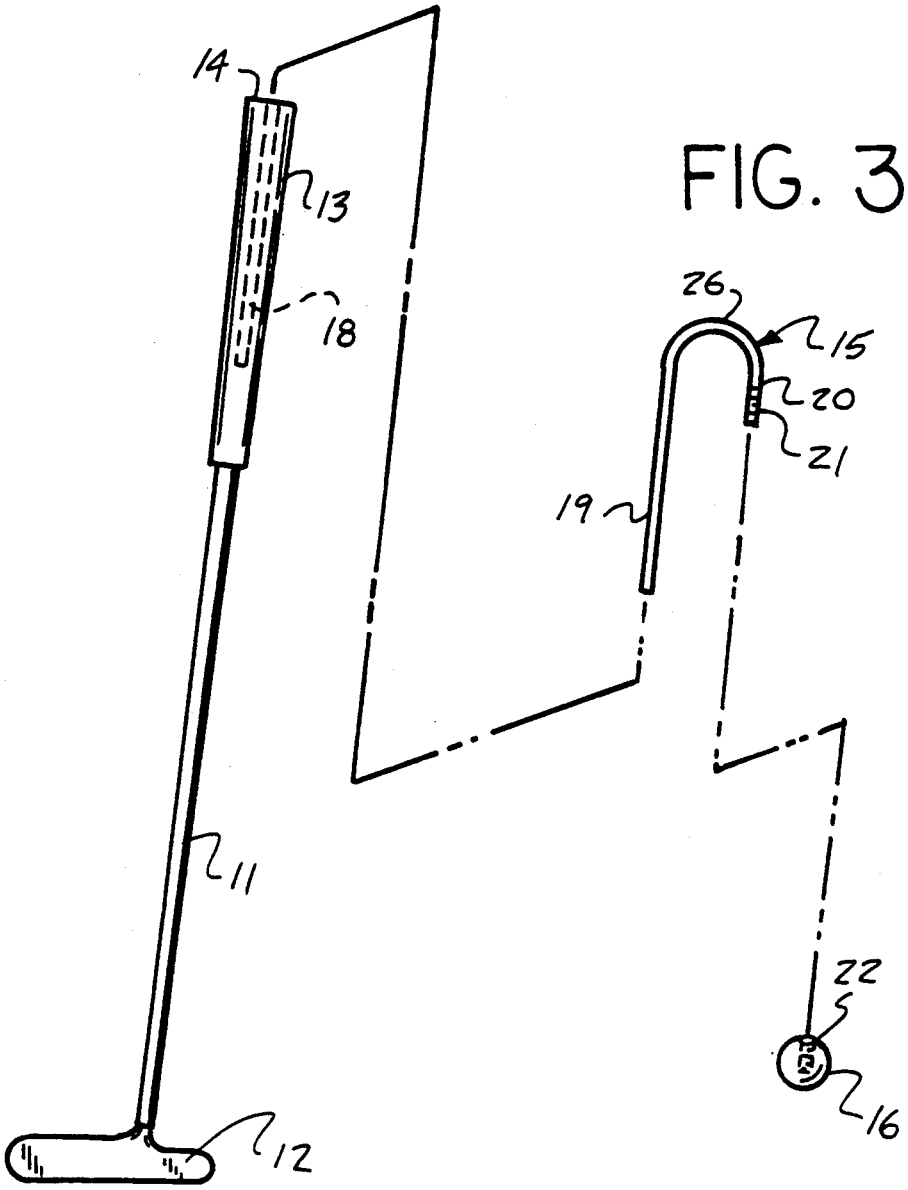
FIG. 3 is an orthographic view indicating the various components in a disassembled configuration.
Figure 4:
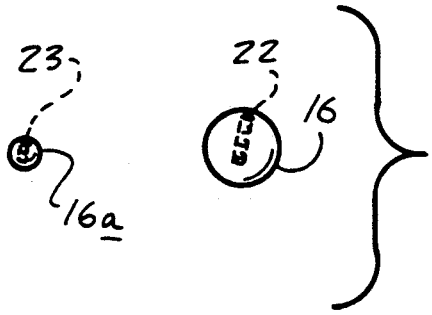
FIG. 4 is an orthographic view of a plurality of counterweight members arranged for employment by the invention.

With reference now to the drawings, and in particular to FIGS. 1 to 8 thereof, a new and improved golf club counterweight apparatus embodying the principles and concepts of the present invention and generally designated by the reference numeral 10 will be described.

More specifically, the golf club counterweight apparatus 10 of the instant invention essentially comprises a golf club shank 11 having a club head 12, with the head having a head forward end 12*a* spaced from a rear end 12*b* on opposed sides of the shank 11. The shank includes a handle 13 mounted to the shank in a spaced relationship relative to the head 12. The handle includes a handle free end 14, wherein a rigid substantially J-shaped support rod 15 is provided extending from the free end positioned over the club rear end 12*b*. A counterweight member 16 is mounted to the support rod 15 at a junction 17, with the junction oriented substantially in adjacency to the free end 14 in a spaced relationship. In this manner, the golfer's hands are positioned between the counterweight and the handle in a predetermined manner, and wherein the configuration of the rigid J-shaped support rod 15 includes a first leg 19, an intermediate arcuate leg portion 26, and a second leg 20 positioned to the individual's body relative to the counterweight apparatus in a desired manner. The handle 13 includes a handle bore 18 coaxially aligned with the handle and the shank 11 to receive the support rod first leg 19 therewithin. The intermediate arcuate leg 26 spaces the second leg 20, wherein the second leg includes a second leg threaded portion 21 to permit threaded reception of the counterweight member 16 of a first diameter or a further counterweight member 16*a* of a second diameter, wherein the second diameter and the first diameter are of differing sizes to provide for variance of the counterweight structure relative to the golf club. Further, the counterweight 16 and the further counterweight 16*a* include respective threaded and further threaded bores 22 and 23 to receive the threaded end portion 21.

Figure 5:
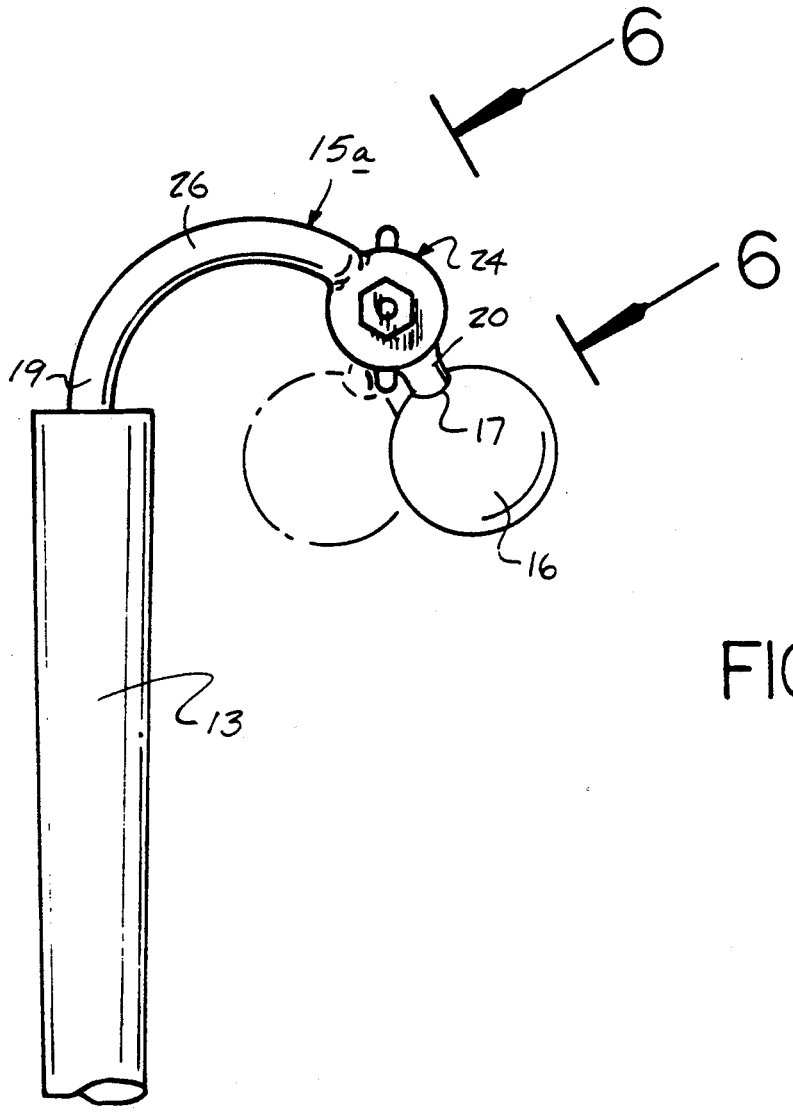
FIG. 5 is an orthographic view of a modified support rod structure of the invention.
Figure 6:
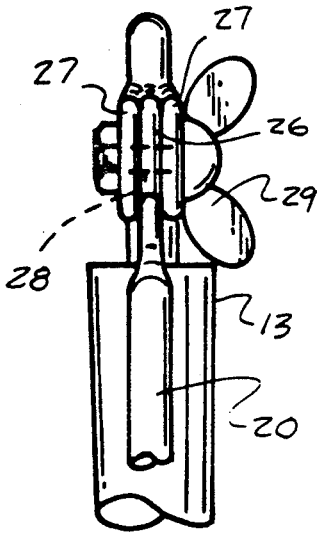
FIG. 6 is an orthographic view, taken along the lines 6—6 of FIG. 5 in the direction indicated by the arrows.

The FIG. 5 indicates the use of a modified support rod 15*a*, wherein the intermediate leg 26 of the second leg 20 are joined by a pivot connection 24. A second leg plate mounted to the second leg spaced from the junction 17 is positioned medially of leg portion space plates 27, with a fastener rod 28 directed orthogonally through the plates terminating in a fastener rod head 29 to permit selective angular orientation of the counterweight 16 relative to the handle 13 for adjustment of the apparatus relative to an individual golfer's physiology.

Figure 7:
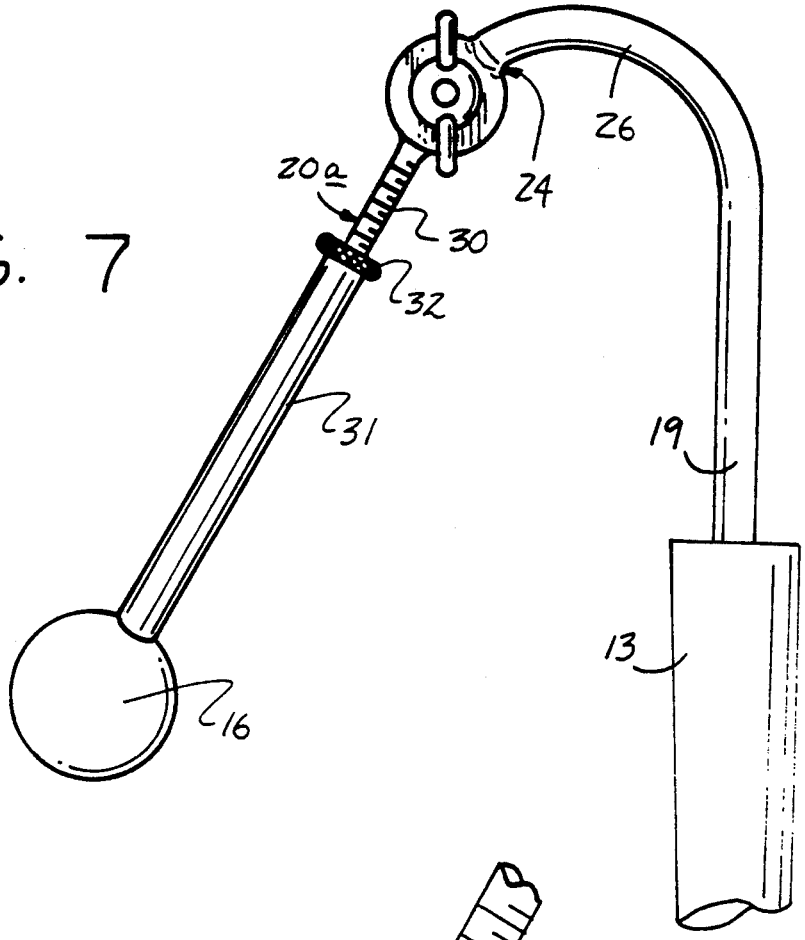
FIG. 7 is an orthographic view of a further modified support rod structure employing a modified second leg portion.
Figure 8:
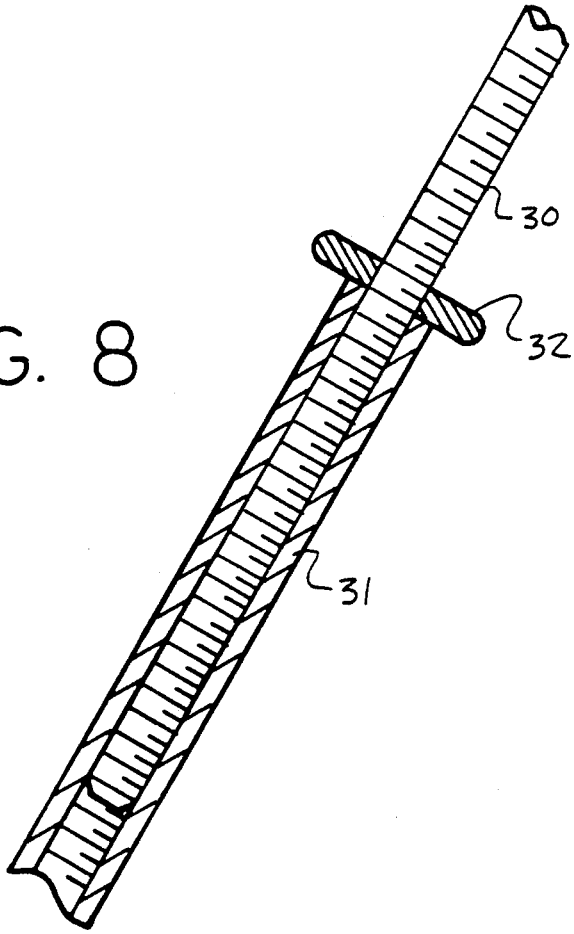
FIG. 8 is a cross-sectional illustration, somewhat enlarged, of the second leg portion of the support rod structure of FIG. 7.

The FIGS. 7 and 8 further includes a modified second leg 20*a*, including a second leg threaded rod portion 30 extending from the pivot connection 24 that is received within an internally threaded sleeve 31 extending from the threaded rod portion 30 to the counterweight 16. A lock fastener 32 threadedly directed about the threaded rod portion 30 is arranged for abutment with the sleeve 31 to provide for axial positioning of the sleeve relative to the threaded rod portion 30 in a desired spacing of the counterweight 16 relative to the pivot connection 24 to further provide for accommodation and adjustment of the structure relative to individual golfers.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf club counterweight apparatus, comprising, an elongated shank, the shank including a golf club head at a first end of the shank, and a handle mounted to the shank extending along the shank to a shank second end, with the handle including a handle free end, and the golf club head including a head forward end and a golf club rear end positioned on opposed sides of the shank, and a rigid J-shaped support rod directed into the shank medially of and coaxially aligned relative to the shank and the handle and extending from the handle free end, the support rod having a support rod first leg, and the handle having a handle bore coaxially aligned with the handle and the shank and receiving the first leg, and an arcuate intermediate leg extending from the first leg and a second leg extending from the arcuate intermediate leg, the second leg including a counterweight mounted to the second leg spaced from the intermediate leg at a second leg free end, wherein the counterweight and the second leg are joined together at a junction, with the counterweight positioned over the golf club head rear end.

2. An apparatus as set forth in claim 1 wherein the junction is positioned in adjacency to the handle free end.

3. An apparatus as set forth in claim 2 wherein the second leg includes a second leg threaded end portion, and the counterweight includes a counterweight threaded bore for threaded securement to the second leg threaded end portion, and a further counterweight having a further counterweight threaded bore, and the further counterweight threaded bore is arranged for selective securement to the second leg threaded end portion upon removal of the counterweight member relative to the second leg threaded end portion, wherein the counterweight is of a first diameter, and the further counterweight is of a second diameter less than the first diameter.

4. An apparatus as set forth in claim 3 wherein the intermediate leg and the second leg are joined together at a pivot junction, with the second leg having a second leg plate directed into the pivot junction, and the intermediate leg having intermediate leg space plates receiving the second leg plate intermediate thereof, with a fastener rod directed through the space plates and the second leg plate, and a fastener head arranged for securement to the fastener rod for fixedly securing the second leg plate and the space plates relative to one another in a predetermined pivotal relationship to permit spacing of the counterweight relative to the handle.

5. An apparatus as set forth in claim 4 wherein the second leg includes a fastener rod extending from the pivot junction and an internally threaded sleeve threadedly receiving the fastener rod therewithin, wherein the sleeve extends from the fastener rod to the counterweight, and a lock fastener threadedly mounted to the fastener rod for abutment with the sleeve for fixed securement of the sleeve relative to the fastener rod upon adjustment of the fastener rod relative to the sleeve.

* * * * *